US006410845B2

(12) United States Patent
Reede

(10) Patent No.: US 6,410,845 B2
(45) Date of Patent: Jun. 25, 2002

(54) APPARATUS FOR ADJUSTING THE COUPLING REACTANCES BETWEEN TWISTED PAIRS FOR ACHIEVING A DESIRED LEVEL OF CROSSTALK

(75) Inventor: Ivan Reede, Dollard des Ormeaux (CA)

(73) Assignee: Nordx/CDT, Inc., Pointe-Claire (CA)

( * ) Notice: Subject to any disclaimer, the term of this patent is extended or adjusted under 35 U.S.C. 154(b) by 0 days.

(21) Appl. No.: 09/778,574

(22) Filed: Feb. 7, 2001

Related U.S. Application Data

(63) Continuation of application No. 09/276,004, filed on Mar. 25, 1999, now Pat. No. 6,255,593.

(60) Provisional application No. 60/102,233, filed on Sep. 29, 1998, and provisional application No. 60/120,950, filed on Feb. 19, 1999.

(51) Int. Cl.[7] ..... H01B 11/00; H01B 11/02; H01B 7/00; H01B 9/00

(52) U.S. Cl. ..... 174/27; 174/113 R; 174/76

(58) Field of Search ..... 174/110 R, 113 R, 174/117 F, 117 FF, 36, 74 R, 84 R, 27

(56) References Cited

U.S. PATENT DOCUMENTS 4,359,597 A * 11/1982 Parquin et al. ..... 174/34
4,404,424 A * 9/1983 King et al. ..... 174/34
4,413,469 A * 11/1983 Paquin ..... 57/293
4,486,253 A * 12/1984 Gonia ..... 156/51
4,616,717 A * 10/1986 Luetzow ..... 174/117 F
4,767,891 A * 8/1988 Biegon et al. ..... 174/34
4,800,236 A * 1/1989 Lemke ..... 174/36
4,837,405 A * 6/1989 Bonjour et al. ..... 174/36
4,920,234 A * 4/1990 Lemke ..... 174/36
4,992,625 A * 2/1991 Izui et al. ..... 174/36
5,142,105 A * 8/1992 Kihlken et al. ..... 174/112
5,602,953 A * 2/1997 Delage et al. ..... 385/101
6,043,434 A * 3/2000 Prudhon ..... 174/113 R

* cited by examiner

*Primary Examiner*—Dean A. Reichard
*Assistant Examiner*—William H. Mayo, III
(74) *Attorney, Agent, or Firm*—Wolf, Greenfield & Sacks, P.C.

(57) ABSTRACT

A method and apparatus for adjusting the coupling reactances between twisted pairs contained within a data communications cable is disclosed. An isolation element is used to isolate one or more twisted pairs of wires from the other twisted pairs of wires contained within the data communications cable. The isolation element may be constructed of dielectric, conductive, or ferromagnetic materials or a combination thereof. It may also include various shapes, patterns, and/or windows for creating a specified level of crosstalk among the twisted pairs contained within the cable.

49 Claims, 9 Drawing Sheets

APPARATUS FOR ADJUSTING THE COUPLING REACTANCES BETWEEN TWISTED PAIRS FOR ACHIEVING A DESIRED LEVEL OF CROSSTALK

CROSS REFERENCE TO RELATED APPLICATIONS

This application is a continuation of U.S. patent application Ser. No. 09/276,004, filed Mar. 25, 1999, now patented as U.S. Pat. No. 6,255,593. U.S. patent application Ser. No. 09/276,004 claims domestic priority under 35 U.S.C. §119 (e) to U.S. Provisional Patent Application Ser. Nos. 60/102, 233 and 60/120,950, filed Sep. 29, 1998 and Feb. 19, 1999, respectively.

FIELD OF THE INVENTION

The present invention relates to high-speed data communication cables. More particularly, it relates to a high-speed data communication cable with adjustable coupling reactances between the twisted pairs within a cable to establish a known, consistent, and repeatable crosstalk level between the twisted pairs within a cable.

RELATED ART

High speed data communications cables in current usage include pairs of wire twisted together forming a balanced transmission line. Such pairs of wire are referred to as twisted pairs.

One common type of conventional cable for high-speed data communications includes multiple twisted pairs within it. In each twisted pair, the wires are twisted together in a helical fashion, thus forming a balanced transmission line. Twisted pairs that are placed in close proximity, such as within a cable, may transfer electrical energy from one pair of the cable to another. Such energy transfer between pairs is undesirable and is referred to as crosstalk. Crosstalk is electromagnetic noise coupled to a twisted pair from an adjacent twisted pair, or from an adjacent cable. Telecommunications systems contain noise that interferes with the transmission of information. Crosstalk increases the interference to the information being transmitted through the twisted pair. The increased interference due to crosstalk can cause an increase in the occurrence of data transmission errors and a concomitant decrease in the data transmission rate. The Telecommunications Industry Association (TIA) and Electronics Industry Association (EIA) have defined standards for crosstalk in a data communications cable that include: TIA/EIA 568-A-2, published Aug. 14, 1998. The International Electrotechnical Commission (IEC) has also defined standards for data communications cable crosstalk, including ISO/IEC 11801 that is the international equivalent to TIA/EIA 568-A. One high performance standard for data communications cable is ISO/IEC 11801, Category 5.

Crosstalk is primarily capacitively coupled or inductively coupled energy passing between adjacent twisted pairs within a cable. Among the factors that determine the amount of crosstalk energy coupled between the wires in adjacent twisted pairs, the center-to-center distance between the wires in the adjacent twisted pairs is very important. The center-to-center distance is defined herein to be the distance between the center of one wire of a twisted pair to the center of another wire in an adjacent twisted pair. The magnitude of both capacitively coupled and inductively coupled crosstalk is inversely proportional to the center-to-center distance between wires. Increasing the distance between twisted pairs can thus reduce the level of crosstalk interference. Another factor relating to the level of crosstalk is the distance over which the wires run parallel to one another. Twisted pairs that have longer parallel runs typically have higher levels of crosstalk occurring between them.

In twisted pairs, the rate of the twist is known as the twist lay, and it is the distance between adjacent twists of the wire. The direction of the twist of a twisted pair is known as the twist direction. Adjacent twisted pairs having the same twist lay and/or opposing twist directions tend to lie more closely together within a cable than if they have different twist lays and/or same twist directions. Thus, compared to twisted pairs having different twist lays and/or same twist directions, adjacent twisted pairs having the same twist lay and opposing directions have a reduced center-to-center distance, and longer parallel run. Therefore, the level of crosstalk energy coupled between the wires in adjacent twisted pairs tends to be higher between twisted pairs that have the same twist lay and/or opposing directions as compared to other twisted pairs that have different twist lays and/or same twist directions. Thus, the unique twist lay serves to decrease the level of crosstalk between the adjacent twisted pairs within the cable. Therefore, twisted pairs within a cable are sometimes given unique twist lays when compared to other adjacent twisted pairs within the cable.

As the continuous twisted or helical structure reaches a termination point, for example as the cable is terminated to be joined to a connector, the helical structures of the individual twisted pairs are deformed to mate with contacts in the terminating hardware creating a de-twisted region within the cable. The actual angle of arrival of the helix of the individual twisted pairs in relation to the mating hardware depends on where the cable is cut within its length. Therefore, the amount of deformation required to align the conductors of the wire pair with the connection points can vary from twisted pair to twisted pair within a cable. The random nature of the deformation of the helical structure creates undesirable inter-pair coupling variations from one connector to the next. Therefore, although the unique twist lay and twist direction can reduce the level of crosstalk within the cable, the de-twisting action produces a level of crosstalk that tends to be random.

In an attempt to reach cross-manufacturer compatibility, EIA/TIA mandates a known coupling level in Category 5 mating hardware. Mating hardware is designed, via counter-coupling, to compensate for the mandated coupling level in order to establish a predetermined level of coupling in a data communications link over a Category 5 cable. The variability in the inter-pair coupling encountered from one plug to the next serves to limit the effectiveness of the counter-coupling compensation.

This specified, standard level of coupling within the mating hardware is provided so that overall the system can have a level of crosstalk that ensures that the particular transmission standard is properly met. Although it is possible to reduce the actual amount of coupling in the mating hardware to improve overall performance, this is not desirable in order to be in compliance with the appropriate standards and reverse compatibility reasons as well. What is preferable is a constant, repeatable and known level of crosstalk. If a Category 5 plug is connected to a superior performance jack, it is expected that the plug and jack will be able to meet Category 5 coupling specifications. This means that the jack/plug must be able to counter-couple for the level of coupling specified for a Category 5 plug/jack. In addition, if two superior performance connectors are used, it is reasonable to expect that the superior performance mating hardware is able to counter-couple for the level of coupling specified for the superior performance hardware.

It is desirable for the crosstalk occurring in the region adjacent to where the twisted pairs have exited from the cable be of a known, consistent, repeatable, and standard value in order to mate with the connecting hardware. At least part of the region is herein referred to as the "detwisted" portion of the cable. Various conventional methods have been used in an attempt to improve the consistency of counter-coupling within the cable and jack or plug. For example, the use of shielded connectors, lead frames, and complex electronic counter-coupling have been used. However, these methods often increase the time required for installation, may require special tools, and can increase the material cost due to a larger parts count. This may lead to market acceptance problems due to the increased costs associated with the special tooling and the additional training required.

SUMMARY OF THE INVENTION

The present invention provides an improved method and apparatus for creating consistent, known, and repeatable levels of crosstalk between twisted pairs within a data cable by adjusting the coupling reactances between twisted pairs.

According to one aspect, the apparatus for adjusting the coupling reactances includes a cable having a plurality of twisted pairs. The cable has a de-twisted region where the twisted pairs transition from a twisted configuration to an untwisted configuration and are arranged in a predetermined configuration. An isolation element is located in the de-twisted region of the cable controlling the coupling between adjacent pairs.

In one embodiment, the isolation element may be constructed of a dielectric material, a conductive material, or a ferromagnetic material. In another embodiment, the present invention may also include an isolation element having a window defined therethrough for selectively adjusting the coupling reactances between the twisted pairs within the cable. In another embodiment, the isolation element may have a nonhomogeneous dielectric constant over its length to vary the electrical thickness of the isolation element. Alternatively, the isolation element may vary in its physical thickness over its length, and/or the dielectric constant of the material may vary over its length to vary the electrical thickness of the isolation element. In another embodiment of the present invention, the isolation element may have a pattern of features including gaps for adjusting the coupling reactances between the twisted pairs within the cable.

In another aspect of the present invention a cable having a standard level of crosstalk relative to a conventional cable is disclosed. The cable has a plurality of twisted pairs and de-twisted region where the twisted pairs transition from a twisted configuration to an untwisted configuration and arranged for mating with associated mating hardware. In one embodiment, a means for isolating the two wires comprising one of the plurality of the twisted pairs from the two wires comprising an adjacent twisted pair, and for adjusting the coupling reactances within the de-twisted region of the cable to achieve a desired level of crosstalk between the twisted pairs is disclosed. In one embodiment, the means for isolating may include an isolation element that can have at least one window defined therethrough. The window or windows are sized and arranged for creating and adjusting coupling reactances between the adjacent twisted pairs.

In another aspect of the present invention a terminated cable having a desired level of crosstalk and controlling crosstalk characteristics is disclosed. The cable has a plurality of twisted pairs and a de-twisted region where the twisted wire transitions from a twisted configuration to an untwisted configuration and are linearly arranged. The cable may include a means for creating a larger center-to-center distance between a wire of one twisted pair and a wire of an adjacent twisted pairs. The means for creating a larger center-to-center distance include an isolation element having a varying thickness and/or a varying dielectric constant.

In another aspect of the invention, a cable having a repeatable level of crosstalk terminated with mating hardware includes a plurality of twisted pairs of conductors, that exit from the cable into a first region adjacent to the exit region of the cable, and an isolation element having top and bottom surfaces, and an end region distal to the exit region of the cable, and constructed and arranged to physically separate and at least partially electrically isolate individual twisted pairs from one another, and a second region adjacent to the end region of the isolation element, wherein each twisted pair is detwisted and oriented to electrically mate with the mating hardware.

In one embodiment, the isolation element includes a plurality of main channels on the top surface of isolation element and at least one main channel on the bottom surface of the isolation element, wherein each of the plurality of twisted pairs are disposed within a single main channel. In another embodiment, the main channels have two sub-channels and have a ridge vertically extending between them forming the two sub-channels into a W shape with each sub-channel containing one wire of a twisted pair.

In another embodiment, the isolation element can include a laminated structure with at least first, second, and third layers. In one embodiment, the first layer is a conductor and the second and third layers are dielectric materials. In one embodiment, the first layer is composed of stainless steel, and in another embodiment, the second and third layers are composed of MYLAR® tape. MYLAR®, as used herein, includes polyester film in general that retains good physical properties over a wide temperature range, has a high tensile tear and impact strength, is inert to water, is moisture-vapor resistant and is unaffected and does not transmit oils, greases, or volatile aromatics. In particular, one form of polyester can be polyethylene terephthalate. In another embodiment, the first layer of the laminated structure is at virtual ground with respect to the plurality of twisted pairs.

In another embodiment, the plurality of twisted pairs of conductors have a distance between adjacent twists of the wire equal to a twist lay and the first region has a length between one-half and one twist lays.

BRIEF DESCRIPTION OF THE DRAWINGS

In the drawings in which like reference numerals designate like elements.

DETAILED DESCRIPTION

Generally, the present invention adjusts the coupling reactances between twisted pairs within a cable to establish a known level of crosstalk. An isolation element that is in a detwisted region of the cable adjusts the coupling reactances. The isolation element separates and, at least partially isolates electrically, at least two wires in adjacent twisted pairs within the cable. The isolation element generally may be constructed from dielectric, conductive or ferromagnetic materials. The isolation element may have a pattern having multiple openings, or a single window defined therethrough, to allow coupling of electric, magnetic or electromagnetic fields between various wires within the cable. The windows and openings may establish a desired level of crosstalk between the wires.

The present invention may be implemented in generally any cable utilizing twisted pairs. However, the illustrated embodiments of the present invention are shown particularly for a cable containing four separate twisted pairs. The inventive principles of the present invention can be applied to cables including greater or fewer numbers of twisted pairs according to the present invention.

Figure 1:
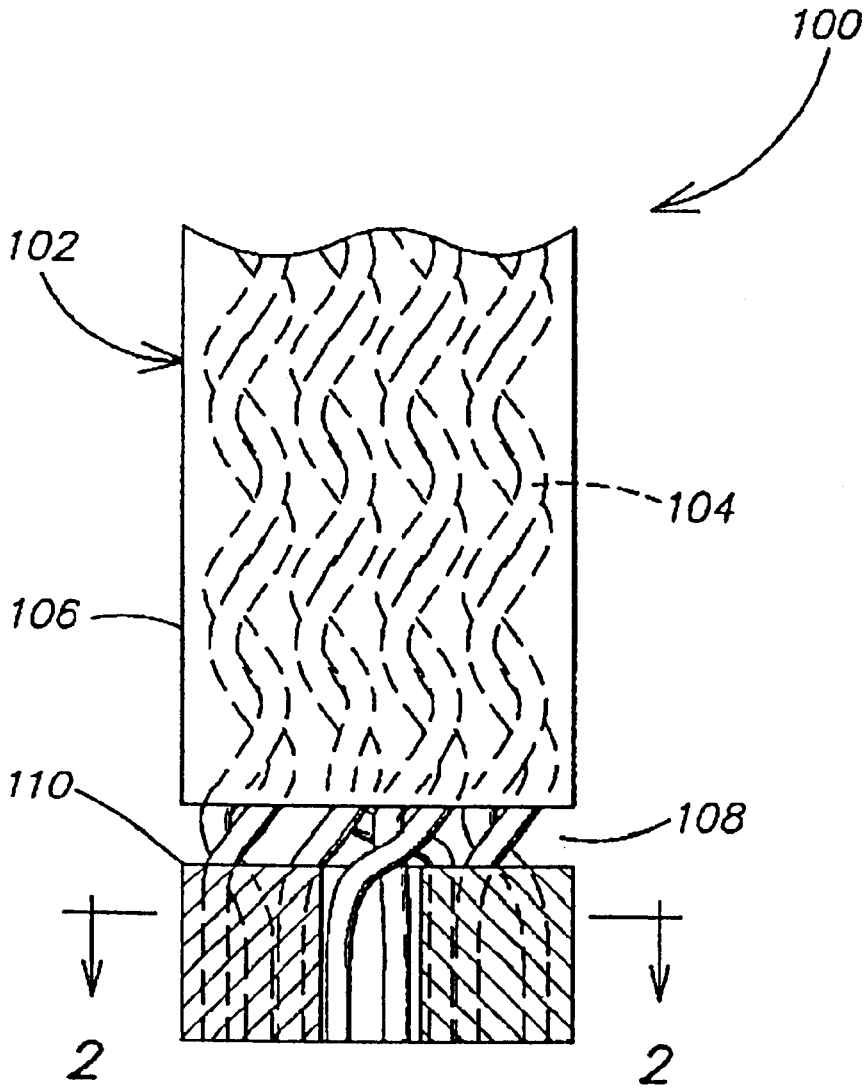
FIG. 1 is top view of a cable and an isolation element according to one embodiment of the invention.

FIG. 1 is a top view of one embodiment of the present invention for adjusting the coupling reactances 100 in a cable 102. Cable 102 in the illustrated embodiment comprises multiple twisted pairs of insulated conductors 104 contained within a cable jacket 106. Cable 102 further contains a detwisted region 108 where the twisted pairs 104 exit from the cable jacket and transition to an arrangement suitable for mating with a piece of mating hardware (not shown). Mating hardware or connectors as used herein include plugs, jacks, punch down blocks, or any connection techniques used by those of ordinary skill in the art when interconnecting telecommunications cables. An isolation element 110 is configured within the detwisted region 108 of cable 102. The isolation element 110 separates the two wires of one twisted pair from the two wires of another twisted pair contained within the cable.

Figure 2:
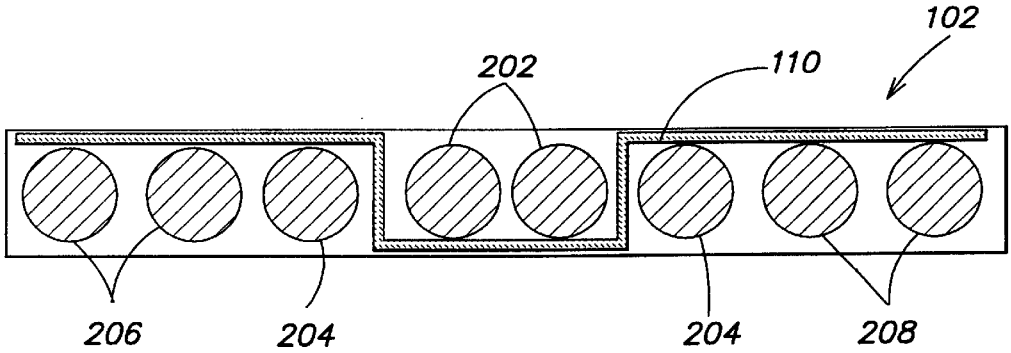
FIG. 2 is a cross-sectional view of the cable and isolation element according to the embodiment of FIG. 1 taken along line 2—2 in FIG. 1.
Figure 4:
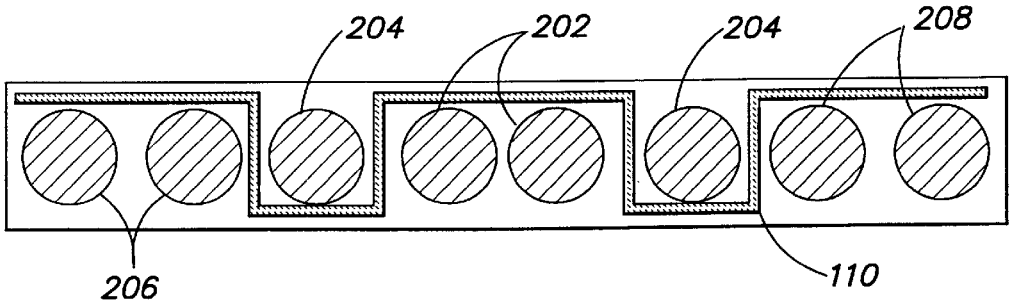
FIG. 4 is a cross-sectional view of a cable and isolation element according to the embodiment of the invention shown in FIG. 3 taken along line 3—3 in FIG. 3.
Figure 3:
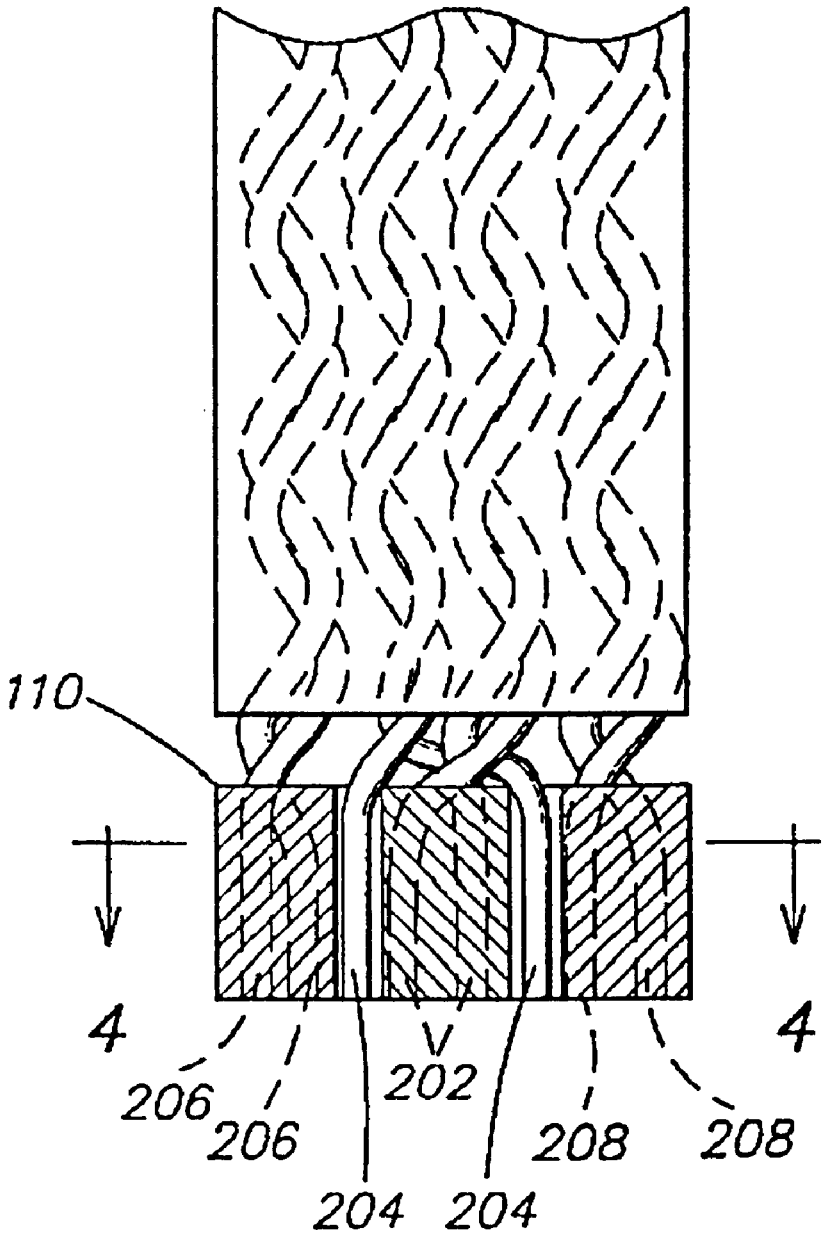
FIG. 3 is a longitudinal cross-sectional view of a cable and isolation element according to another embodiment of the present invention.

FIG. 2 shows a cross section of the present invention taken along line 2—2, shown in FIG. 1. Cable 102 comprises four twisted pairs of insulated conductors within a cable jacket. Pair 1, a pair of insulated conductors 202, is the innermost pair of the wires shown in FIG. 2, and has isolation element 110 placed at least partially and surrounding it, isolating pair 202 from the wires of pair 204 as shown. Similarly, as shown in FIGS. 3 and 4, pair 204 can be isolated from pairs 206, 208, and 202. Similarly, pair 206 or pair 208 could also be isolated from the adjacent pairs as well.

Isolation element 110 may achieve a specified and repeatable level of crosstalk between wires of adjacent twisted pairs.

In one embodiment of the present invention, isolation element 110 is composed of dielectric materials. In this embodiment, isolation element 110, does not act as a shield preventing the coupling of electromagnetic fields from among the various twisted pairs of insulated conductors. Instead, isolation element 110 by virtue of having a given thickness and being disposed between two wires of two adjacent twisted pairs, increases the center-to-center distance between the adjacent twisted pairs and thus reduces the level of crosstalk between the twisted pairs. In addition, because isolation element 110 is a dielectric material, it can affect both the magnitude and phase of time-varying electromagnetic fields passing through it. Controlling the phase and magnitude of time-varying electromagnetic fields passing through the isolation element 110 couples energy between twisted pairs within a cable to achieve a desired crosstalk level.

Figure 6:
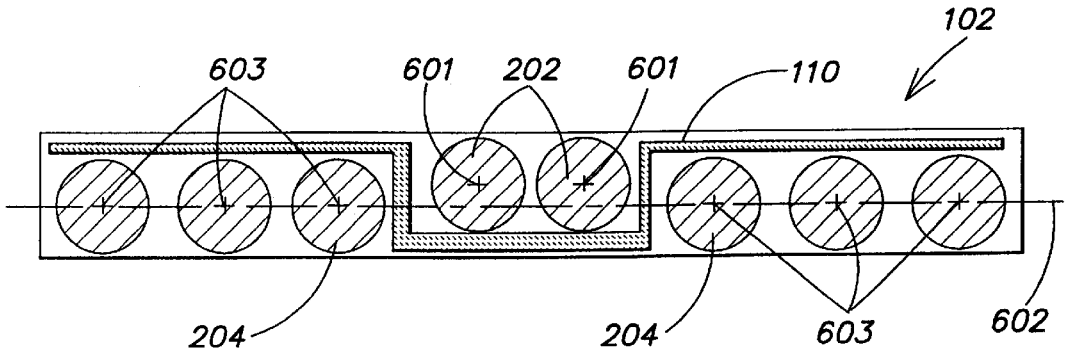
FIG. 6 is a cross-sectional view of a cable and isolation element according to the embodiment of the invention in FIG. 5 taken along line 6—6 in FIG. 5.

Crosstalk caused by the coupling of time-varying electric and magnetic fields between twisted pairs within a cable is known to be caused predominantly by capacitive and inductive coupling among the individual wires comprising the twisted pairs. As described above, the level of capacitively and inductively coupled energy between the individual conductors is inversely proportional to the square of the center-to-center distance between the wires in adjacent twisted pairs. Therefore, the thickness of isolation element 110 may be used to establish a particular level of coupling between the twisted pairs. As shown in FIG. 6, the center-to-center distance between the wires of adjacent twisted pairs may be further increased by using the thickness or shape of isolation element 110 to raise the centers 601 of the isolated twisted pair 202 out of the transverse plane 602 defined by the centers 603 of the conductors 204. In this way, the center-to-center distance between the adjacent pairs of insulated conductors may be increased beyond the width of the isolation element 110.

As described above, passing a time-varying electric, magnetic, or electromagnetic field through a dielectric material having a different dielectric constant than its surrounding environment may affect both the magnitude and phase of the time-varying field. The crosstalk signal coupled into a twisted pair can be thought of as a vector having a magnitude and a phase. By selectively coupling a second crosstalk interference signal with a specific magnitude and phase to the existing crosstalk signal, the total resultant crosstalk will be the vectorial combination of the selectively coupled signal and the existing crosstalk. Therefore, the total resultant crosstalk within a twisted pair can be controlled by selectively coupling energy between adjacent wires.

The phase and magnitude of a time-varying field passing through a dielectric material is a function of the physical thickness of the material and also of the dielectric constant of the material. Because the dielectric constant of a material determines the speed of propagation of a time-varying electromagnetic field passing through the material, the wavelength of the time-varying field will be given by, $\lambda_m = C_m/f$, where $\lambda_m$ is the wavelength of the time varying field within the material, and Cm is the speed of propagation of the time varying field within the material. The combination of the dielectric constant and physical thickness therefore, determines the electrical thickness of the cable. The electrical thickness of a dielectric material is defined herein to be the number of wavelengths thick a dielectric material is at a given frequency. Hence, a dielectric material will have a different electrical thickness depending on the frequency of interest.

Changing the magnitude and phase of a time-varying electromagnetic signal is equivalent in an electronic circuit paradigm to passing the signal through a reactance network producing an output signal having a particular phase and magnitude. These reactances, hereinafter referred to as coupling reactances, are designed to produce time-varying electric, magnetic, or electromagnetic fields having a particular phase and magnitude that are coupled between twisted pairs within the cable. As described above, varying the magnitude and phase of the time varying electromagnetic signal allows the selective addition and subtraction of the vectorial components of those fields in order to achieve a desired level of crosstalk among the twisted pairs.

As noted above, passing a time-varying field through one or more selected dielectric materials creates a time-varying electric, magnetic, or electromagnetic field having a particular phase and magnitude. Dielectric slabs may be stacked together to have an effect on the time-varying field based on the thickness and dielectric constant of each slab, and the dielectric constant of the surrounding environment. Therefore, it is possible to couple a time-varying electric, magnetic, or electromagnetic field with a desired magnitude and phase by varying the thickness of the dielectric material through which the field passes, the dielectric constant of the material through which the field passes, or a combination of the thickness and the dielectric constant. As explained above, varying the dielectric constant of the material is equivalent to varying the electrical thickness of the material. In addition, the layers of differing dielectric constant and varying thickness may be laminated together to achieve this result.

A mathematical model of the process can also be used for the design of the isolation element 110. Using transmission line theory, the various dielectric materials and their thicknesses may be modeled as transmission lines. The transmission lines will have various reactances due to the characteristics of the materials and lengths equal to the electrical length of the dielectric material. Using techniques known in the art, dielectric layers may be designed in terms of dielectric constant and thickness to achieve a desired electrical length which produces the desired magnitude and phase of coupling reactances between the twisted pairs.

In another embodiment of the present invention, the isolation element 110 may be constructed of a conductive material. It is known in electromagnetic field theory that a conductor placed in the path of a time-varying electric, magnetic, or electromagnetic field theoretically, prevents that time varying electromagnetic field from passing through the conductor, thus shielding the opposite side of the conductor from the time-varying field. There can be a small penetration of the conductor by the time-varying field. The depth of the penetration into the conductor by the time-varying field is known as penetration depth or skin depth and is inversely proportional to the conductivity of the material and the frequency of the time-varying field. The penetration or skin depth is dependent upon the frequency, conductivity and thickness of the material, and, in general the more conductive the isolation element, the better the shielding properties are. For example, silver, copper, and aluminum foil, will provide superior shielding relative to the shielding provided by some other conductive materials. However, the present invention is not limited to merely these materials. Other materials may be doped with conductive atoms or ions, in order to affect the magnitude and the phase of the energy passing through the isolation element. The isolation element 110 may therefore be constructed of sheets of metallic foil, such as silver, copper or aluminum, or the isolation element also may be constructed of plastic materials that have been ionized or doped with conducting atoms in order to increase their conductivity level and still retain properties associated with a dielectric boundary as well.

The thickness of the conducting material that is to be used as shielding may be selected by calculating the penetration or skin depth of the conductive material at the typical frequency that is to be transmitted over the various twisted pairs. Additionally, materials may be constructed having both conductive and dielectric properties in order to create a coupling electric, magnetic, or electromagnetic field that has the desired magnitude and phase in order to be coupled to other insulated conductors within the cable for creating a predetermined and desired level of crosstalk.

Using similar techniques as described above, the partial shielding of the twisted pairs may be modeled as transmission lines and the coupling of various time-varying fields. Using a transmission line model, the various signals that are to be coupled together with existing cross talk signals in order to achieve the desired cross talk levels can be derived. Once these levels are known, shielding may be developed to selectively allow signals to couple between twisted pairs to achieve the level of crosstalk desired.

In another embodiment of the present invention, the isolation element 110 may be constructed of ferromagnetic materials in order to create compensating reactances for adjusting the phase and magnitude of a magnetic or electromagnetic field coupling between two insulated conductors within the cable. By adjusting the permeability constant of the isolation element 110, the magnitude and phase of a magnetic field, or electromagnetic field, coupling between two insulated conductors within the cable may be adjusted in a similar manner as described above in connection with varying the dielectric constant of the isolation element 110. Also as above, the isolation element 110 may be designed having a combination of dielectric constant, conductivity, and permeability in order to optimize the magnitude and phase of the electric, magnetic, or electromagnetic fields that are being used to adjust the level of crosstalk among the insulated conductors within the cable to a specified level.

Figure 5:
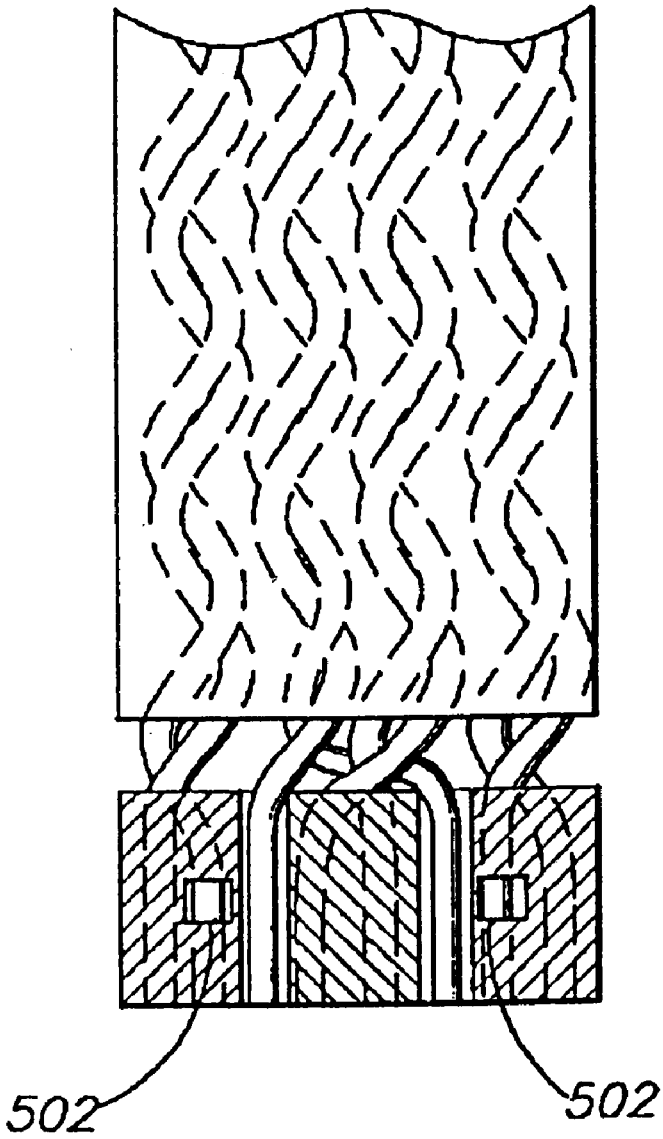
FIG. 5 is a longitudinal cross-sectional view of another embodiment of the present invention.

In another embodiment of the present invention as shown in FIG. 5, the isolation element may include a gap or a window 502 defined therethrough. The window 502 is sized and positioned such that at least one insulated conductor of two or more twisted pairs of insulated conductors are visible through the window 502. Although a window can be used with isolation element 110 constructed of dielectric materials, control of the phase and the magnitude of the electric, magnetic, or electromagnetic energy coupled between the two twisted pairs may be better controlled if the window 502 is utilized in conjunction with an isolation element 110 composed of conducting or ferromagnetic materials. By selectively allowing energy to be coupled from one wire to an adjacent wire in another twisted pair at a particular location and shielding the wires elsewhere in it is possible to develop a coupling signal that vectorially adds to the existing crosstalk signal and generates a resultant crosstalk signal that is of the desired level. Also, isolation element 110 may also be formed in various patterns containing a plurality of windows or openings defined therethrough to control the phase and magnitude of the coupled energy (not shown). In addition, the windows or patterns may be filled with dielectric material to create particular phase and magnitudes of coupling signals in order to achieve the desired level of coupling.

Figure 7:
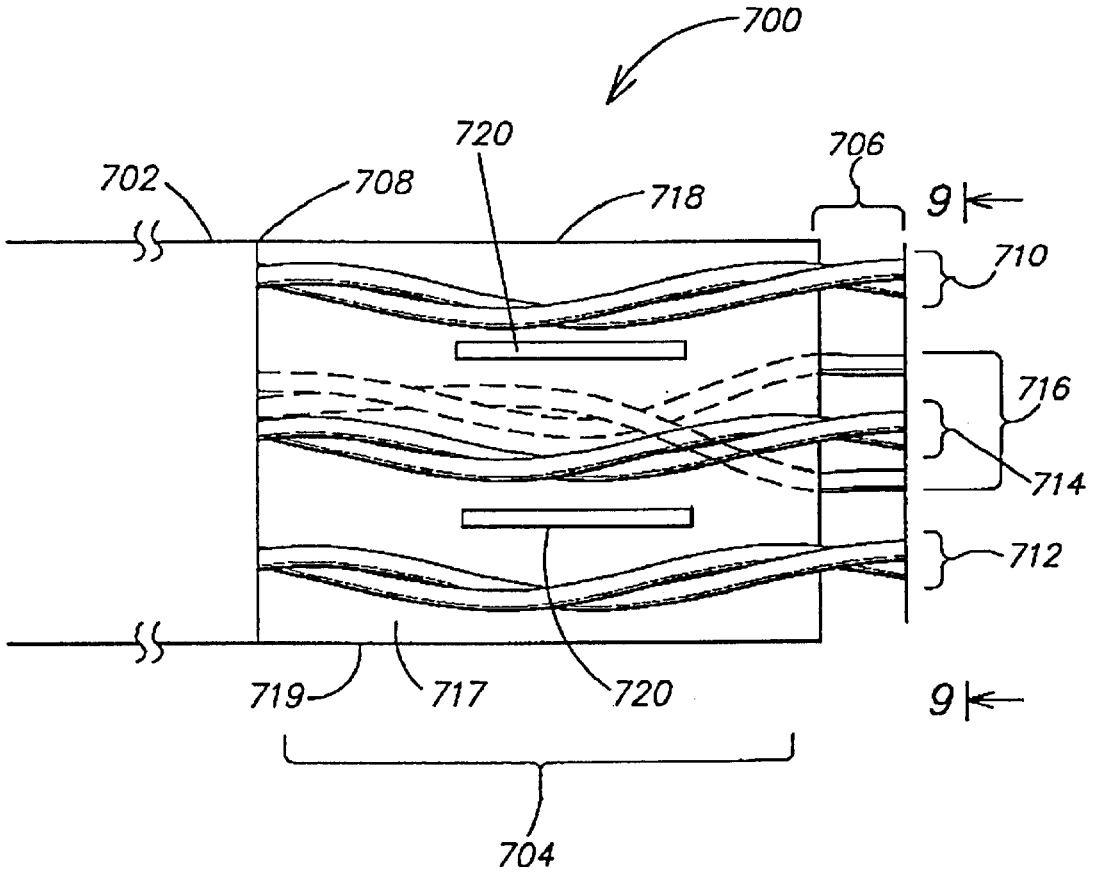
FIG. 7 is top view of a cable and an isolation element according to one embodiment of the invention.

A preferred element for adjusting the coupling reactances between twisted pairs is shown in FIG. 7, comprising a cable 702, a twisted region 704 and a de-twisted region 706 for attachment to a plug or jack or other mating hardware (not shown). The cable 702 may include a plurality of twisted pairs and each twisted pair can have a unique twist lay and twist direction as described above. In a preferred embodiment, the cable 702 includes four twisted pairs 710, 712, 714, 716.

The twisted pairs exit cable 702 at cable exit 708 and enter twisted region 704, adjacent to, and external to, cable 702. Within twisted region 704, the twisted pairs are separated from one another and may be arranged with three twisted pair on a first side 717 of isolation element 718 and one pair on a second side 719 of isolation element 718. In one embodiment, the three twisted pairs may be separated from each other by at least one pair of wire guides 720. Preferably, the wire guides 720 may be constructed from a non-conductive material such as plastic.

Preferably, isolation element 718 is a conductive material such as copper or silver, and in one embodiment may be stainless steel. In another embodiment, the isolation element 718 can be constructed from dielectric materials doped with conductive impurity atoms to establish a given level of conductance.

Isolation element 718 should form a virtual ground with respect to the wires forming the twisted pairs 710, 712, 714, 716. A virtual ground as used herein is a point at 0 volts with respect to other nodes within the circuit but not connected to a "real" or system ground point. For isolation element 718 to be maintained at 0 volts relative to each of the twisted pairs 710, 712, 714, 716, each of the twisted pairs 710–716 should be substantially the same electrical distance from the isolation element 718. Thus, a material having a different dielectric constant would have a different physical thickness in order to achieve the same electrical thickness.

During the manufacturing process of wires, conductors are often not placed perfectly within the center of the insulation surrounding them resulting in eccentricities within the wire. Because most wires are produced with a double twisting action, i.e., as the wires are twisted around each other, the individual wires are also back twisted so that the orientation of the wires with respect to each other is not constant, and varies with a given period. Over the length of the twisted pairs, the changing orientation of the wires helps to ensure that on the average, the wires are correct distance from each other. The same theory would be true for the twisted region if the twisted region was several twist lengths long. However, the twisted region 704 extends for approximately one-half to one twist length and any eccentricities present in the wires may cause the isolation element being different distances from various wires, resulting in isolation element 718 being at a non-zero voltage with respect to the wires. Thus, isolation element 718 would not be at virtual ground for all the wires.

Figure 8:
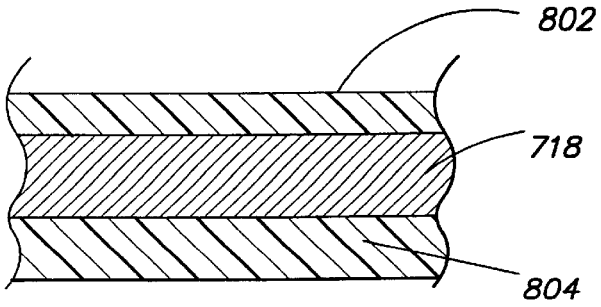
FIG. 8 is a cross sectional view of the isolation element according to one embodiment of the present invention.

To reduce the effect of wire eccentricities, in one embodiment, isolation element 718 may be covered with a dielectric material forming a laminated structure as shown in FIG. 8. The dielectric material, which in one embodiment is MYLAR® tape, is used to increase the distance between isolation element 718 and wires of the twisted pairs. The increase in distance between the wires and the isolation element may be much larger than the eccentricities within the wire. The MYLAR® tape therefore, may proportionally reduce the effect of any eccentricity of the position of the wire within the conductor. The increase distance can reduce the effects caused by the eccentricity of the wire and may increase the stability of isolation element 718 as a virtual ground with respect to the twisted pairs 710, 712, 714, 716.

In one embodiment shown in FIG. 8, the dielectric layers, 802 and 804, covering isolation element 718 do not have to be the same width.

Figure 9:
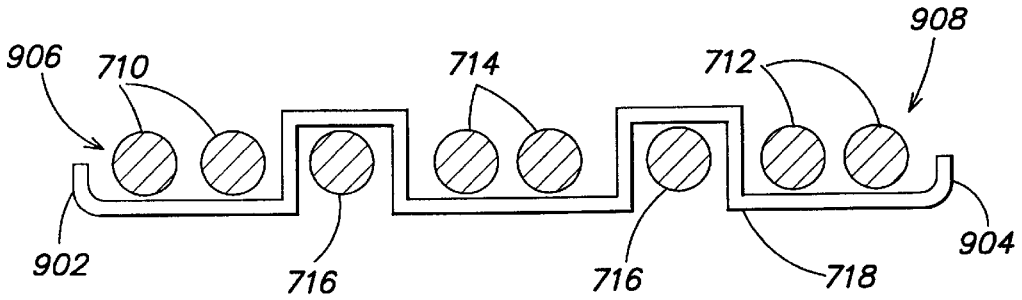
FIG. 9 is a front view of the isolation element according to the embodiment of FIG. 7 taken along line 9—9 in FIG. 7.

In another embodiment as shown in FIG. 9, the isolation element 718 includes curved end portions 902 and 904 that extend around and partially surround the outer two conductors 906 and 908, respectively.

Figure 10:
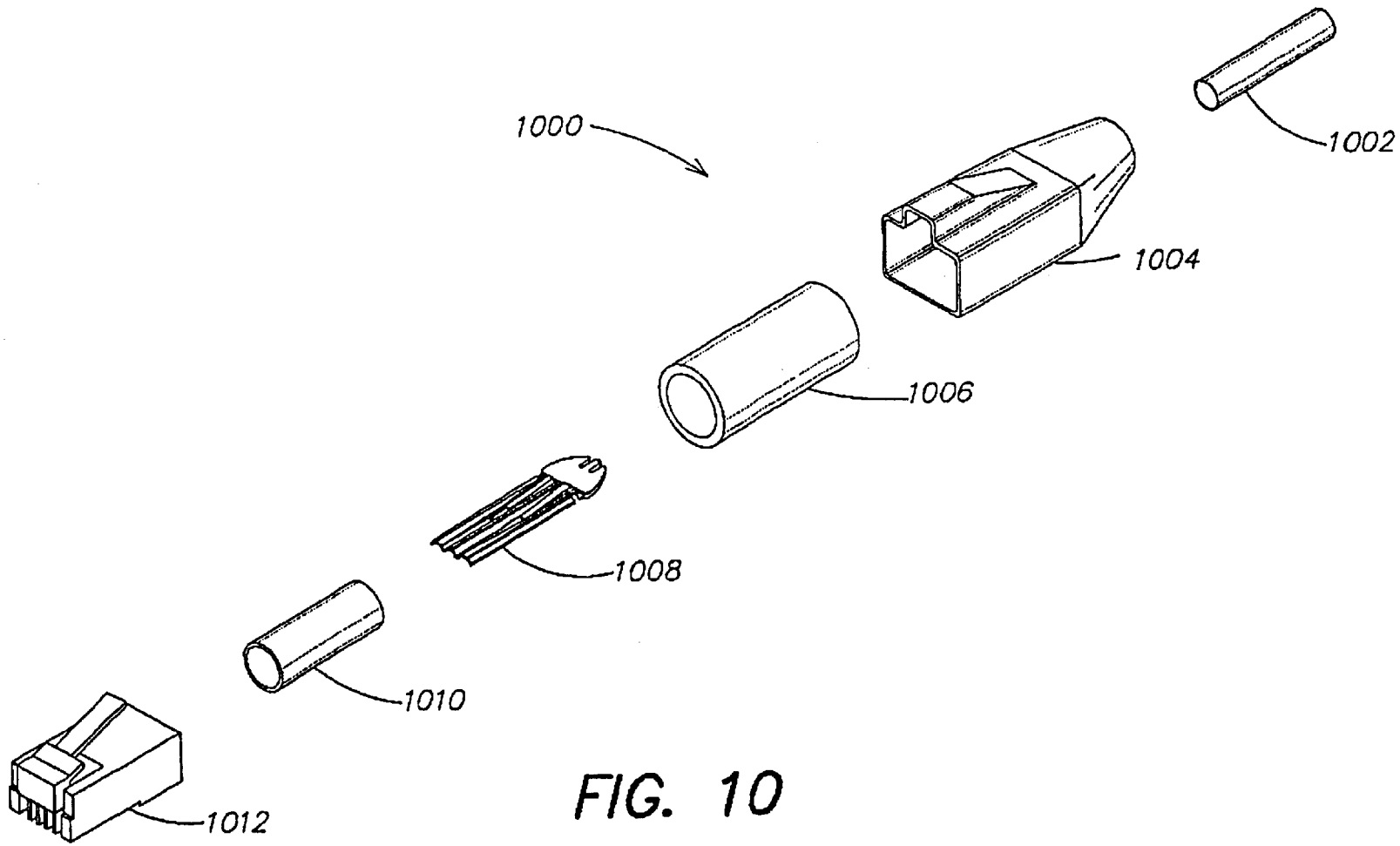
FIG. 10 is an exploded view of a cable according to one embodiment of the invention.

FIG. 10 illustrates a preferred embodiment of a cable termination 1000 according to the present invention. The cable termination 1000 includes the cable containing 4 twisted pairs 1002, a cable boot 1004 that is designed to house the cable termination hardware, a strain relief 1006, an isolation element 1008, shrink tubing 1010 designed to be fitted over the isolation element 1008 for physically securing the twisted pairs within their individual trajectories, and a modular plug 1012. Preferably, the isolation element 1008 is a laminated material consisting of a 0.003 inch steel foil covered on both sides with MYLAR®, polyester, foils, of 0.0025 inches and 0.0065 inches, respectively. The shrink tubing 1010 is used to keep in place the twisted pairs once the wires have been properly placed and dressed on the isolation element 1008. An adhesive liner on the shrink tubing advantageously prevents the dressed wires from migrating across the isolation element 1008 during assembly. In another embodiment not shown, the wires may be crimped to provide the necessary mechanical stability. However, the process of crimping the wires may induce errors in the desired trajectories and introduce unwanted variations in the level of crosstalk and in the characteristic impedance. Thus, crimping the wires, while mechanically sound may degrade the performance of the fixture. Preferably, simple heating equipment will be needed to shrink the tubing. The cable boot 1004 is provided with the plug for appearance and color identification. The strain relief 1006 is used to provide effective strain relief between the cable jacket and the modular plug shell. This enables the connector to pass the mechanical pull test without having to crimp the wires together. Strain relief 1006, in one embodiment, is used to provide increased mechanical stability for the isolation element 1008 because the isolation element 1008 may extend beyond the plug shell and not allow the jacket of the cable to be crimped by the plastic bar within the plug 1012.

In one embodiment, the isolation element 1008 can be adjusted by moving the metal foil forward toward the modular plug 1012 or backwards toward the cable 1002. This has the effect of increasing or decreasing the length of the parallel run of wires prior to mating with the modular plug 1012. Thus, by moving isolation element 1008 forward toward the plug, the parallel run length is decreased and thus, the crosstalk between adjacent wires is also decreased. By moving the isolation element 1008 rearward toward the cable 1002, the parallel run length of a adjacent wires is increased and thus the level of crosstalk is increased as well. Advantageously, this allows the terminated cable according to one embodiment of the invention to be adapted to changing crosstalk standards in the future. In one embodiment, the movement of isolation element 1008 may be accomplished during production and in another embodiment, a field adjustable isolation element may be used.

Figure 11:
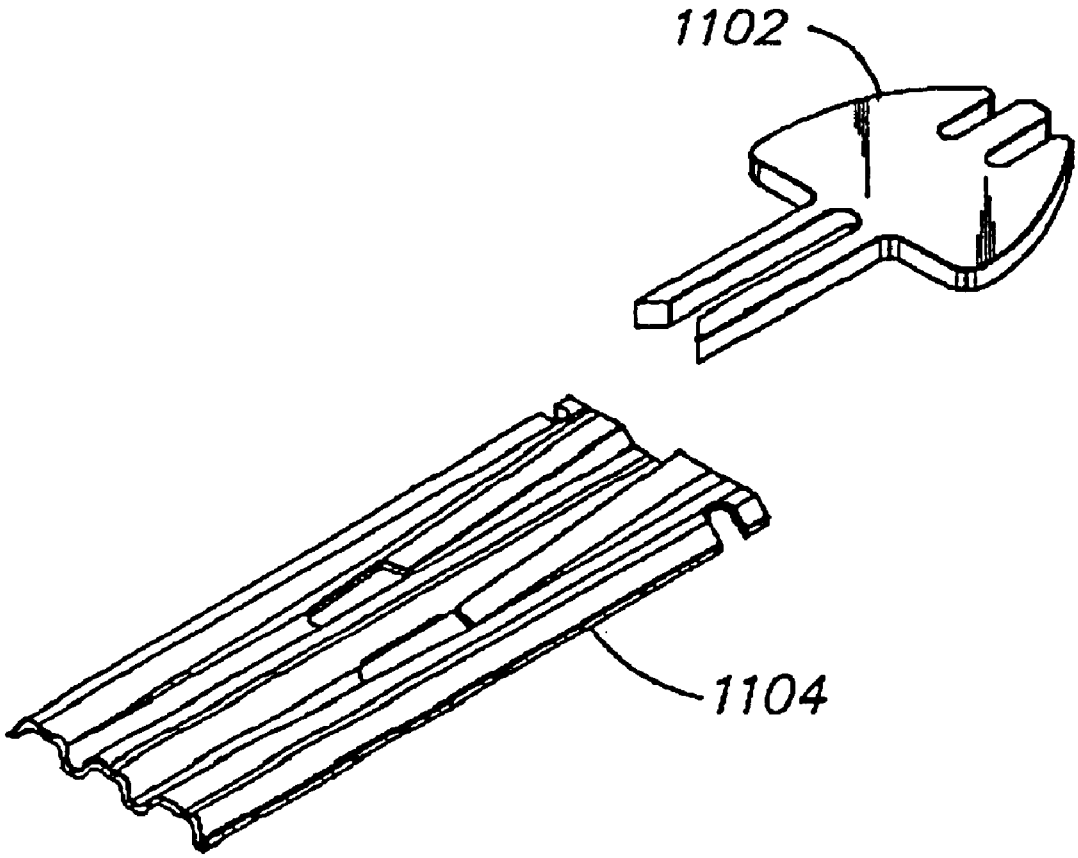
FIG. 11 is an exploded view of an isolation element according to one embodiment of the invention.

FIG. 11 illustrates a preferred embodiment of isolation element 1008 that is comprised of a molded bar 1102 and a formed foil management bar 1104. The molded bar can be an injection molded plastic bar that is fitted onto 804 and extends into the 4 pair cable (not shown).

The present invention has now been described in connection with a number of specific embodiments thereof.

However, numerous modifications which are contemplated as falling with in the scope of the present invention should now be apparent to those skilled in the art. Therefore, it is intended that the scope of the present invention be limited only by the scope of the claims appended hereto.

What is claimed is:

1. A terminated cable assembly having a desired level of crosstalk comprising:

a cable having a plurality of twisted pairs, the twisted pairs each having two insulated conductors, the cable having an exit region where the twisted pairs exit the cable;

a de-twisted region transversely adjacent to the exit region wherein the twisted pairs transition into an untwisted configuration and are arranged to mate with connecting hardware; and an isolation element located in the de-twisted region of the cable, the isolation element controlling coupling between adjacent pairs;

wherein the isolation element includes a plurality of channels that are open along a longitudinal length of the isolation element, the plurality of twisted pairs being disposed in the open channels.

2. The terminated cable assembly as in claim 1, wherein the isolation element controls a phase of the coupling between adjacent pairs.

3. The terminated cable assembly as shown in claim 1, wherein the isolation element controls a magnitude of the coupling between adjacent pairs.

4. The terminated cable assembly as in claim 1, wherein the isolation element is conductive.

5. The terminated cable assembly as in claim 4, wherein the conductive isolation element is metallic foil.

6. The terminated cable assembly as in claim 1, wherein the isolation element selectively adjusts coupling reactances between the plurality of twisted pairs to adjust the desired level of crosstalk to a desired value.

7. The terminated cable assembly as in claim 1, wherein the isolation element selectively adjusts coupling reactances to adjust a magnitude of crosstalk to a desired value.

8. The terminated cable assembly as in claim 1, wherein the isolation element selectively adjusts coupling reactances to adjust a phase of crosstalk to a desired value.

9. The terminated cable assembly as in claim 1, wherein the isolation element is dielectric material having a dielectric constant and also having an electrical thickness.

10. The terminated cable assembly as in claim 9, wherein the isolation element has a length, and the dielectric constant varies over the length for varying the electrical thickness of the isolation element over the length.

11. The terminated cable assembly as in claim 1, wherein the isolation element forms a strip having free ends, the isolation element having a thickness for separating the two insulated conductors of one of the plurality of twisted pairs from the two insulated conductors of another of the plurality of twisted pairs.

12. The terminated cable assembly as in claim 1, wherein the isolation element includes a length and a thickness and the thickness varies over the length of the isolation element for selectively adjusting coupling reactances to achieve the desired level of crosstalk.

13. The terminated cable assembly as in claim 1, wherein the isolation element includes a length and a thickness wherein the thickness varies over the length of the isolation element for selectively adjusting coupling reactances between the plurality of twisted pairs to adjust a magnitude of crosstalk to a predetermined value.

14. The terminated cable assembly as in claim 1, wherein the isolation element includes a length and a thickness wherein the thickness varies over the length of the isolation element for selectively adjusting coupling reactances between the plurality of twisted pairs to adjust a phase of crosstalk to a predetermined value.

15. The terminated cable assembly as in claim 1, wherein the isolation element is a ferromagnetic material.

16. The terminated cable assembly as in claim 1, wherein the isolation element is composed of at least two from a list of a conductive material, a dielectric material, and a ferromagnetic material.

17. The terminated cable assembly as in claim 1, wherein the isolation element has features which create compensating reactances between the plurality of twisted pairs.

18. The terminated cable assembly as in claim 17, wherein the features include regions of reduced thickness.

19. The terminated cable assembly as in claim 17, wherein the features include conductors.

20. The terminated cable assembly as in claim 17, wherein the features include ferromagnetic materials.

21. The terminated cable assembly as in claim 17, wherein the features include dielectric materials.

22. The terminated cable assembly as in claim 21, wherein the features include regions having dissimilar dielectric constants.

23. A terminated cable assembly having a desired level of crosstalk relative to a conventional cable, comprising:

a cable having a plurality of twisted pairs, the twisted pairs each having two insulated conductors;

the cable further having a de-twisted region wherein the twisted pairs transition into an untwisted configuration and are arranged to mate with connecting hardware; and a means for isolating the two insulated conductors of one of the plurality of the twisted pairs from the two insulated conductors of another of the plurality of twisted pairs, wherein the means for isolating also adjusts coupling reactances between the insulated conductors within the de-twisted region of the cable and includes a plurality of channels that are open along a longitudinal length of the isolation element, the insulated conductors being disposed within the channels;

whereby the desired level of crosstalk between the twisted pairs is achieved.

24. A terminated cable assembly having a desired level of crosstalk relative to a conventional cable, comprising:

a cable having a plurality of twisted pairs, the twisted pairs each having two insulated conductors;

the cable further having a de-twisted region where the twisted pairs transition into an untwisted configuration and are arranged to mate with connecting hardware;

means for creating a larger center-to-center distance between the two insulated conductors of one of the plurality of twisted pairs and the two insulated conductors of another of the plurality of twisted pairs than a thickness of insulation of each insulated conductor provides within the de-twisted region of the cable;

whereby electromagnetic coupling is adjusted between individual insulated conductors and the desired level of crosstalk is achieved; and wherein the means for creating a larger center-to-center distance includes a plurality of channels that are open along a longitudinal length of the isolation element, the insulated conductors being disposed within the channels.

25. The terminated cable assembly as in claim 24, wherein the means for creating a larger center-to-center distance includes means for creating a larger electrical length separating the two insulated conductors of one of the plurality of twisted pairs from the two insulated conductors of another of the plurality of twisted pairs than the thickness of insulation of each insulated conductor provides.

26. The terminated cable assembly as in claim 25, wherein the means for creating a larger electrical length is an isolation element having a length and a thickness wherein the thickness varies over the length.

27. The terminated cable assembly as in claim 25, wherein the isolation element has a length and a dielectric constant, and wherein the dielectric constant varies over the length.

28. A cable assembly having a repeatable level of crosstalk terminated with mating hardware, the cable assembly comprising:

a cable containing a plurality of twisted pairs of conductors;

the cable having an exit region wherein the plurality of twisted pairs exit from the cable;

an isolation element having top and bottom surfaces, an end region distal to the exit region of the cable, and constructed and arranged to physically separate and at least partially electrically isolate the twisted pairs from one another;

a second region adjacent to the end region of the isolation element, wherein each twisted pair is detwisted and oriented to electrically mate with the mating hardware; and wherein the isolation element comprises a plurality of main channels on the top surface of the isolation element and at least one main channel on the bottom surface of the isolation element, wherein each of the plurality of twisted pairs is disposed within a single main channel, and the main channels are open along a longitudinal length of the isolation element.

29. The cable assembly as in claim 28, wherein each of the plurality of main channels on the top surface and each of the at least one main channel on the bottom surface of the isolation element has two sub-channels.

30. The cable assembly as in claim 29, wherein each of the sub-channels within a main channel has a ridge vertically extending between the sub-channels forming the two sub-channels into a W shape;

wherein each of the two sub-channels contains a single conductor of the twisted pair disposed within the main channel.

31. The cable assembly as in claim 28, the isolation element further comprising a laminated structure.

32. The cable assembly as in claim 31, wherein the laminated structure of the isolation element includes at least first, second, and third layers, wherein said first layer is a conductor and is disposed between said second and third layers, and the second and third layers are dielectric materials.

33. The cable assembly as in claim 32, wherein the first layer is composed of stainless steel.

34. The cable assembly as in claim 32, wherein the second and third layers are composed of MYLAR® tape.

35. The cable assembly as in claim 32, wherein the first layer is at virtual ground with respect to the plurality of twisted pairs.

36. The cable assembly as in claim 28, wherein the isolation element controls a phase of coupling between adjacent pairs.

37. The cable assembly as in claim 28, wherein the isolation element controls a magnitude of coupling between adjacent pairs.

38. The cable assembly as in claim 28, wherein the isolation element selectively adjusts coupling reactances to adjust the level of crosstalk to a desired value.

39. The cable assembly as in claim 28, wherein the isolation element selectively adjusts coupling reactances to adjust a magnitude of crosstalk to a desired value.

40. The cable assembly as in claim 28, wherein the isolation element selectively adjusts coupling reactances to adjust a phase of crosstalk to a desired value.

41. The cable assembly as in claim 28, wherein the isolation element includes a length and a thickness and the thickness varies over the length of the isolation element for selectively adjusting coupling reactances to achieve a desired level of crosstalk.

42. The cable assembly as in claim 28, wherein the isolation element includes a length and a thickness wherein the thickness varies over the length of the isolation element for selectively adjusting coupling reactances to adjust a magnitude of crosstalk to a predetermined value.

43. The cable assembly as in claim 28, wherein the isolation element includes a length and a thickness wherein the thickness varies over the length of the isolation element for selectively adjusting coupling reactances to adjust a phase of crosstalk to a predetermined value.

44. The cable assembly as in claim 28, wherein the isolation element has features which create compensating reactances between the plurality of twisted pairs.

45. A terminated cable assembly comprising:

a cable including a plurality of twisted pairs of insulated conductors, the cable having a detwisted region where the insulated conductors transition into an untwisted configuration;

an isolation element having a plurality of channels that are open along a longitudinal length of the isolation element, the isolation element at least partially located in the detwisted region of the cable;

wherein the twisted pairs of insulated conductors are disposed within the channels of the isolation element.

46. The terminated cable assembly as in claim 45, wherein a single twisted pair of insulated conductors is disposed within each channel.

47. The terminated cable assembly as in claim 46, wherein a first channel of the plurality of channels includes two sub-channels, and each of the two sub-channels contains a single insulated conductor of the twisted pair of insulated conductors disposed within the first channel.

48. The terminated cable assembly as in claim 45, wherein each of the plurality of channels includes a vertical ridge disposed within the channel that divides the channel into two sub-channels, thereby causing the channel to have a W shape.

49. The terminated cable assembly as in claim 48, each of the two sub-channels contains a single insulated conductor of the twisted pair of insulated conductors disposed within the channel.

* * * * *